United States Patent [19]

Owens

[11] Patent Number: 4,541,750

[45] Date of Patent: Sep. 17, 1985

[54] SURFACE SPREADER WITH COLUMN BYPASS

[75] Inventor: Joe M. Owens, Naperville, Ill.

[73] Assignee: Master Consolidated Corporation, Dayton, Ohio

[21] Appl. No.: 305,167

[22] Filed: Sep. 24, 1981

[51] Int. Cl.[4] ..... E01C 19/18

[52] U.S. Cl. ..... 404/110; 222/609; 280/1; 118/305; 118/308; 118/323; 404/108

[58] Field of Search ..... 222/173, 608–614, 222/623, 625; 404/101, 105.6, 110, 108; 118/305, 207, 108, 308, 323; 182/63, 187; 108/153; 280/1

[56] References Cited

U.S. PATENT DOCUMENTS

| | | | |
|---|---|---|---|
| 1,528,268 | 3/1925 | Schlegel | 182/187 X |
| 2,789,485 | 4/1957 | Lindgren | 404/106 |
| 2,965,987 | 12/1960 | Graves | 404/106 X |
| 4,349,294 | 9/1982 | Allen | 222/556 X |
| 4,411,554 | 10/1983 | Gratzfeld | 404/101 X |

*Primary Examiner*—Robert B. Reeves
*Assistant Examiner*—Russell D. Stormer
*Attorney, Agent, or Firm*—Lee, Smith & Zickert

[57] ABSTRACT

An apparatus for accommodating and avoiding the interference of a column in line with an end of a spreader which applies particulate material to the surface of freshly-poured concrete. The apparatus includes an assembly for attachment to the column for supporting an end of the surface spreader. The column assembly has a horizontal shelf and a device to affix the shelf to the column at a predetermined elevation in registration with the end of the surface spreader. A ski is mounted at the end of the surface spreader and is shaped to engage the shelf and support the end of the surface spreader on the shelf. The ski is maintained at approximately the same elevation as the shelf to readily permit the ski to be moved onto the shelf for support of the end of the surface spreader.

15 Claims, 5 Drawing Figures

82
84
92
90
12
96
86
68
80
76
72
70
64
78

SURFACE SPREADER WITH COLUMN BYPASS

BACKGROUND OF THE INVENTION

This invention relates to surface spreaders for applying particulate material to the surface of freshly-poured concrete, and in particular to an apparatus in combination with the surface spreader for accommodating and avoiding the interference of a column in line with an end of the surface spreader.

With the advent of automatic equipment for tamping and smoothing concrete, concrete is often laid in long, continuous ribbons of a particular width. Several ribbons of concrete may be poured adjacent one another over successive periods of time in order to complete a building floor or other similar surface.

After a ribbon of concrete is freshly laid, it is often desirable to add floating hardeners to the surface of the concrete before the concrete begins to cure. While, in the past, hardeners have been added by hand, hand-casting of hardeners normally leads to very imprecise dispersion of the hardeners across the concrete surface. Thus, various devices have been designed to span the width of a ribbon of freshly-poured concrete and dispense hardeners in a strip fashion across the concrete from a hopper designed to traverse above the concrete and dispense the hardening materials evenly across the concrete.

One problem with such devices is that in a situation where a pole, a building column, or other such obstruction is encountered at the edge of the concrete, the surface spreader must be manually lifted and moved from one side of the obstruction to the other, often precluding use of the surface spreader to spread the curing material in a strip across the concrete adjacent to the obstruction. Thus, dispensing of curing material at this location must be by imprecise hand application. Also, since the surface spreading equipment can span widths of concrete up to 70 feet or more, the surface spreading equipment tends to be quite heavy and bypassing such an obstruction is extremely difficult due to the bulk and weight of the equipment.

SUMMARY OF THE INVENTION

The present invention is designed to eliminate the difficulty in bypassing an obstruction at one end of the surface spreader while permitting the spreading of hardeners or other particulate material to proceed in a normal fashion. The surface spreader can be a typical spreader for applying particulate material in strip fashion to the surface of freshly-poured concrete. The spreader has an elongated framework structure spanning the concrete, a hopper suspended on the framework structure and adapted to traverse the framework structure from one end to the other to spread material across the surface of the concrete, and end supports at either end of the framework structure to support the structure above the concrete.

The invention comprises an apparatus for accommodating and avoiding the interference of a column or other obstruction in line with an end of the surface spreader. The apparatus includes an assembly for attachment to the column for supporting an end of the surface spreader. The assembly has a horizontal shelf and means to affix the shelf to the column at a predetermined elevation in registration with the end of the surface spreader. A ski means is mounted at the end of the surface spreader and is shaped to engage the shelf and support the end of the surface spreader on the shelf. The ski means is mounted on the surface spreader at approximately the same elevation as the shelf to permit the ski to readily engage and support the end of the surface spreader on the shelf.

The column assembly includes a pair of elongated horizontal braces extending from the shelf, the braces being spaced to accept a column therebetween. Each of the braces includes a vertical leg, the leg being attached to the brace such that when the assembly is secured to a column, each leg is on the opposite side of the column from the shelf. The legs are adjustable to alter the elevation of the shelf as required.

In order to affix the shelf to the column, the column assembly has a horizontal bar extending between the horizontal braces on the opposite side of the column from the shelf. In addition, a tether means extends from one leg to the other leg, the tether means being of a sufficient length to pass about the column on the opposite side from the horizontal bar. In accordance with the preferred embodiment of the invention, the tether means comprises an adjustable chain.

In order to permit securing of the column assembly to the column, the horizontal bar is pivotally attached to one of the horizontal braces. The bar is removably attached to the other of the braces so that the bar can be pivoted and the column assembly engaged about the column.

The ski means on the end of the framework structure comprises an elongated plate having upturned ends. In addition, the end supports for the framework are removably attached to the framework in order to permit their detachment when a column is encountered. Each of the end supports for the framework structure preferably includes a leg assembly having a vertical bearing member. A vertical brace having a channel shaped to accommodate the vertical bearing member is attached to the framework structure. The vertical brace has a series of apertures in alignment with a series of apertures in a vertical bearing member so that one or more locking bolts may pass through one of the series of aligned apertures to fasten the vertical bearing member to the brace.

BRIEF DESCRIPTION OF THE DRAWINGS

The invention is described in greater detail in the following description of the preferred embodiment, taken in conjunction with the drawings, in which.

DESCRIPTION OF THE PREFERRED EMBODIMENT

Figure 1:
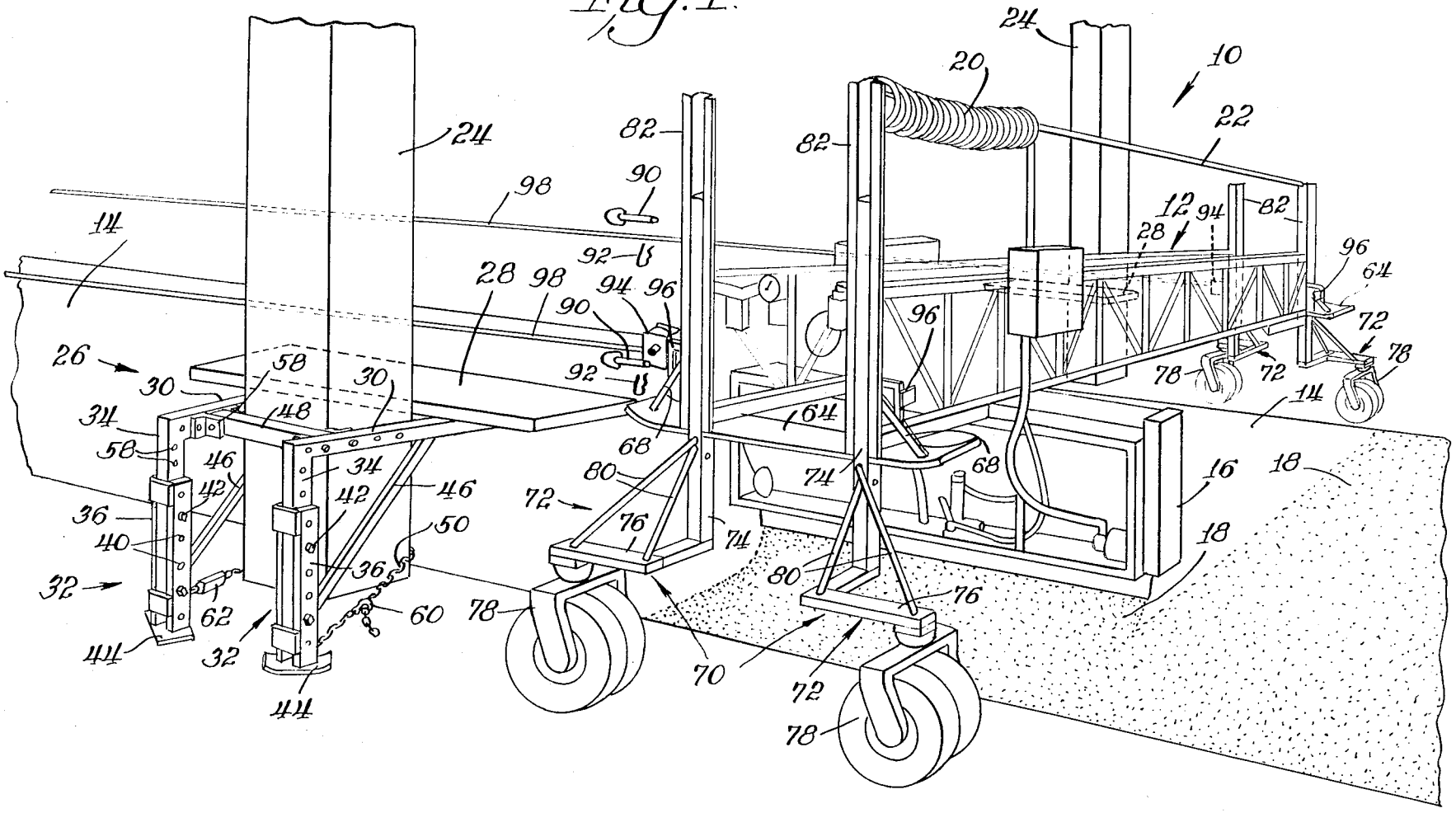
FIG. 1 is a perspective illustration of a surface spreader having a column bypass apparatus according to the invention.

A surface spreader employing a column bypass apparatus according to the invention is generally designated at 10 in FIG. 1. The surface spreader has an elongated framework structure 12 spanning a ribbon of freshly-poured concrete 14. A hopper 16 is suspended beneath the framework structure 12 and is filled with concrete hardeners 18 or other particulate material which is applied to the surface of the freshly-poured concrete in a strip fashion as the hopper 16 traverses the framework structure 12 from end to end. Driving energy, whether electrical, hydraulic or otherwise, is supplied to the hopper 16 through a conduit 20, the conduit 20 being wound in a spring-like fashion and suspended for travel between opposite ends of the framework structure 12 on a cable 22. The framework structure 12, hopper 16 and associated apparatus may be of conventional construction and are, therefore, not described in further detail.

As shown in FIG. 1, a column 24 or other similar post-like obstruction is often encountered at the edge of a ribbon of concrete 14. The invention includes an apparatus for accommodating and avoiding the interference of the column 24 when the column 24 is in line with an end of the surface spreader 10. Thus, the column 24 can be bypassed without affecting the ability of the surface spreader to continue spreading hardener 18 across the surface of the freshly-poured ribbon of concrete 14.

Figure 3:
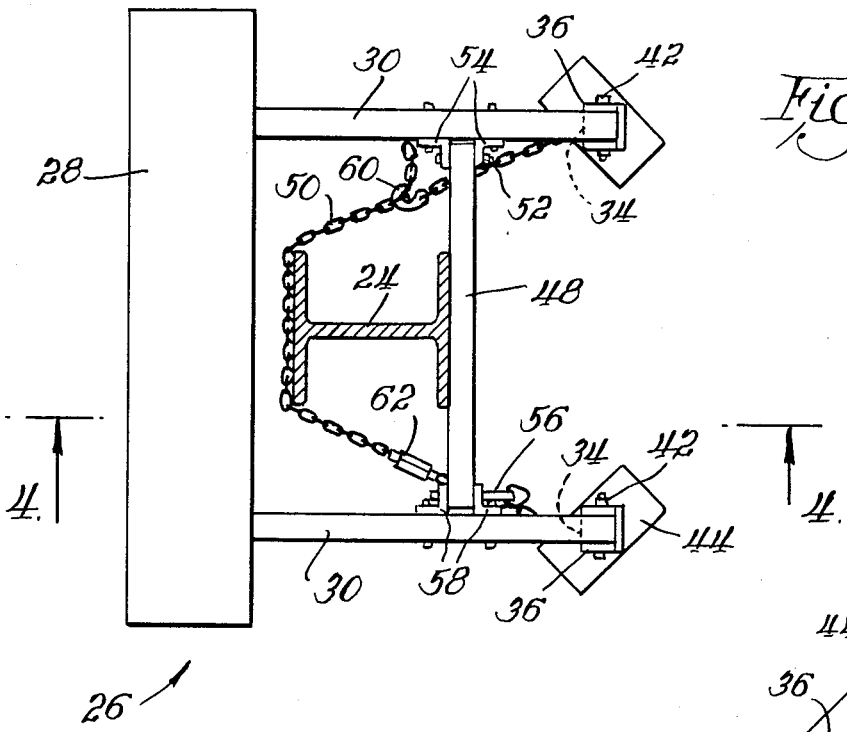
FIG. 3 is a top plan view of the column assembly portion of the invention when secured about a column.
Figure 5:
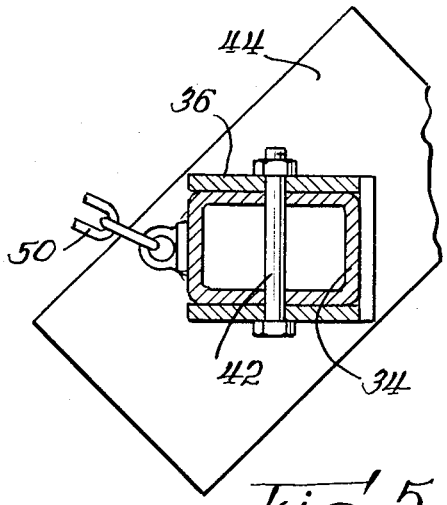
FIG. 5 is an enlarged cross sectional illustration of one leg of the column support taken along lines 5—5 of FIG. 4.
Figure 4:
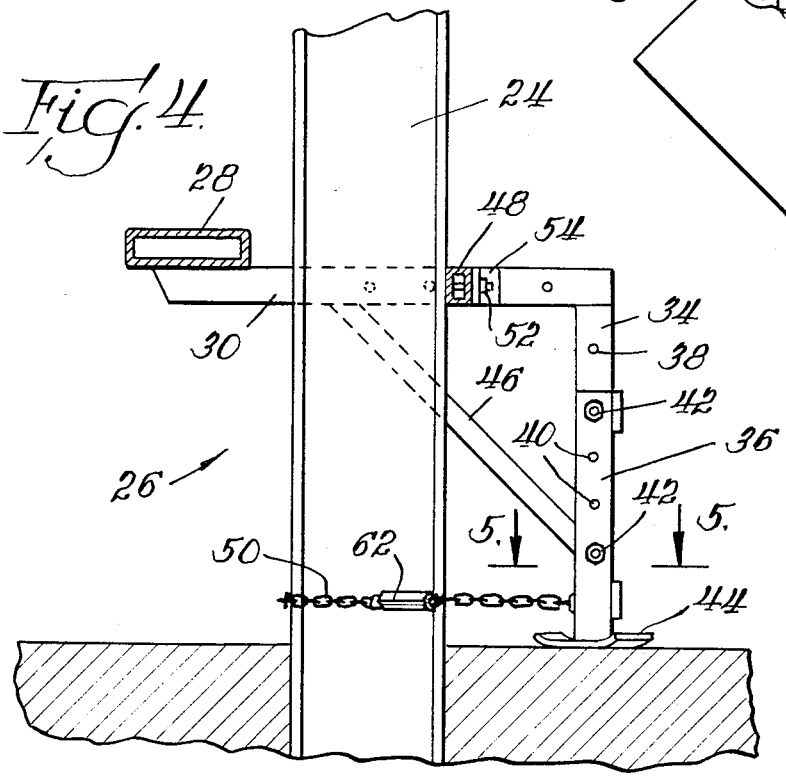
FIG. 4 is a cross sectional illustration taken along lines 4—4 of FIG. 3.

One portion of the invention comprises an assembly 26 for attachment to the column 24 for supporting an end of the surface spreader 10. As best shown in FIG. 1 and FIGS. 3 and 4, the column assembly 26 includes a horizontal shelf 28 situated at a particular elevation above the concrete 14 in line with one end of the surface spreader 10. A pair of elongated horizontal braces 30 are attached beneath the shelf 28 for mounting of the shelf, the braces 30 being spaced sufficiently to accept the column 24 between them.

A vertical leg 32 is attached to each of the horizontal braces 30 as illustrated, with the legs 32 being located at one end of the braces 30 and the shelf 28 at the other end of the braces 30 so that the shelf 28 and legs 32 are situated on opposite sides of the column 24. The legs 32 are adjustable to alter the elevation of the shelf 28. Each leg 32 is composed of an upper leg portion 34 attached to the brace 30 and which is situated within a lower leg portion 36. The leg portion 34 includes a plurality of apertures 38. Similarly, the leg portion 36 includes a plurality of apertures 40 which are spaced to be in alignment with the apertures 38. Therefore, the two leg portions 34 and 36 may be adjusted to raise the shelf 28 to a particular elevation by bolting the two leg portions 34 and 36 together through the apertures 38 and 40. As shown in the drawings, a pair of bolts 42 are used to secure the two leg portions 34 and 36 together.

Each of the legs 32 is terminated at its lower end by a support pad 44 secured to the lower leg portion 36. While the pads 44 are shown as rectangular metallic plates with upturned ends, the pads can be flat, square rather than rectangular, or any other shape so long as the pads are of sufficient size to support the column assembly 26.

As shown in FIGS. 1 and 4, for additional strength, the column assembly 26 can include a brace 46 extending between each of the horizontal braces 30 and the legs 32. Each brace 46 is attached to the upper leg portion 34 and to the brace 30.

With the exception of the bolted joining of the upper leg portion 34 to the lower leg portion 36, all parts of the column assembly 26 are preferably welded to one another where joined in order to assure strength and rigidity of the assembly. Of course, depending on the bearing requirements of the assembly 26, adjoining parts may be bolted or otherwise affixed to one another.

In order to affix the column assembly 26 to the column 24, the assembly includes a horizontal bar 48 and a tether means 50. The bar 48 extends between the horizontal braces 30 on the opposite side of the column 24 from the shelf 28. One end of the bar 48 is pivotally attached by a pin 52 between two angles 54 which are bolted to one of the horizontal braces 30. The other end of the horizontal bar 48 can be attached to the other horizontal brace 30 by means of a removable pin 56 extending through the other end of the bar 48 between a pair of angles 58 which are bolted to the other horizontal brace 30. Thus, when the pin 56 is removed, the bar 48 may be pivoted about the pin 52.

The tether means 50 is composed of an adjustable chain. As best shown in FIGS. 3 and 4, the tether means 50 extends between the vertical legs 32 about the column 24 on the opposite side from the horizontal bar 48. The tether means 50 is separated into two chain portions and includes a hook 60 which is permanently attached to one part of the tether means and which is shaped to engage one of the chain links of the other part of the tether means 50 in order to fasten the tether means together. For fine adjustment of the length of the tether means 50, it also includes a turnbuckle 62.

The assembly 26 is secured about the column 24 by first pivoting the horizontal bar 48 about the pin 52 to the vertical position. The assembly 26 is then moved into place and the horizontal bar 48 is lowered to the horizontal position with the column 24 captured between the horizontal shelf 28 and the horizontal bar 48. The hook 60 is then engaged in one of the chain links of the tether means 50 and, if necessary, the turnbuckle 62 is rotated to lengthen or shorten the tether means 50, as required, so that the tether means 50 is drawn snugly about the column 24, while the horizontal bar 48 bears against the opposite side of the column 24, and the legs 32 are substantially upright.

Figure 2:
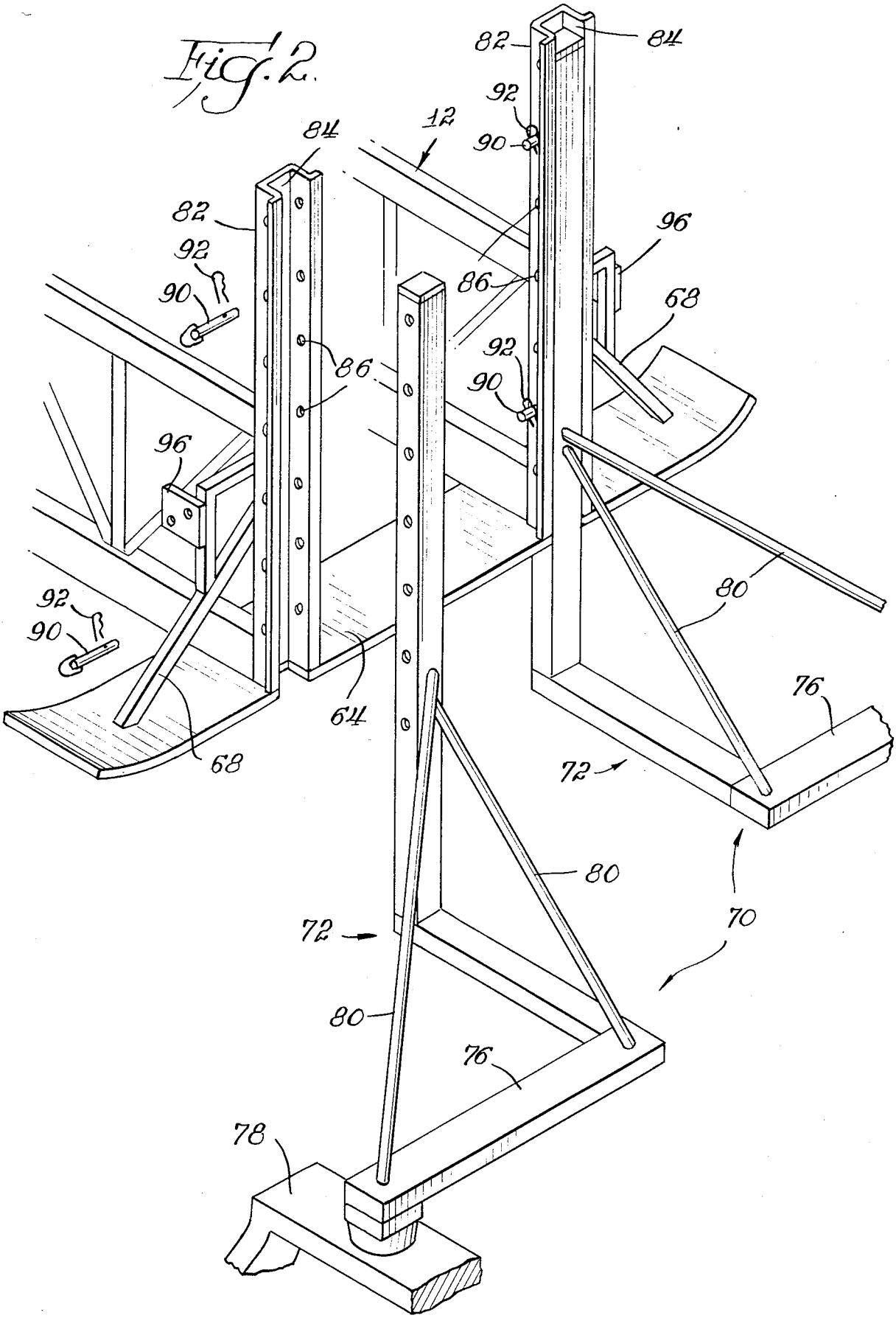
FIG. 2 is an enlarged and partially exploded perspective view of the end of the surface spreader, with portions removed for clarity of explanation.

The second portion of the apparatus for accommodating and avoiding the interference of the column 24 is mounted at one end of the surface spreader 10. As shown in FIGS. 1 and 2, a ski means 64 is secured at the end of the surface spreader 10. The ski 64 is welded or otherwise fixedly secured to the bottom of the framework structure 12 to form a part thereof. The ski 64 comprises an elongated plate and has upturned ends 66 to aid the ski 64 as it is slid upon the horizontal shelf 28, as described in greater detail below. Also, if necessary, the ski 64 may include braces 68 for greater strength and rigidity.

The ski 64, and hence the end of the surface spreader 10, is maintained at approximately the same elevation as the shelf 28 by means of a removable end support 70 including two leg assemblies 72. Each of the leg assemblies 72 includes a vertical bearing member 74 and a horizontal L-shaped arm 76 extending from the base of the bearing member 74. A wheel assembly 78 is attached beneath each of the arms 76 as shown. For added strength and rigidity of the arms 76, a number of braces 80 can be secured between the arms 76 and the vertical bearing members 74.

Each of the bearing members 74 is shaped to engage a vertical brace 82 having an internal channel 84 shaped to accommodate the vertical bearing member 74. Each of the vertical braces 82 has a series of spaced apertures 86 as shown. Likewise, each of the vertical bearing members 74 includes a series of spaced apertures 88, the spacing between the apertures 88 and 86 being equal so that when the bearing members 74 are situated within the channels 84, the leg assembly 72 may be fastened to the vertical brace 82. As shown in FIG. 2, the vertical bearing member 74 can be secured to the vertical brace 82 by means of a plurality of locking bolts which pass through aligned apertures 86 and 88. Each bolt 90 is held in place by a snap pin 92.

Since the surface spreader 10 sits upon the wheel assemblies 78, it is possible to manually push the surface spreader from one location to another in order that succeeding strips of hardener 18 can be dispensed across the surface of the ribbon of concrete 14. To ease moving of the spreader 10 from one location to another, the spreader can also include a winch 94 affixed to a bracket 96 which in turn is securely affixed to the framework structure 12. A cable 98 may be withdrawn from the winch 94 and attached to an immobile object (not illustrated) so that when the cable 98 is wound upon the winch 94, the surface spreader 10 will be drawn in the direction of the immobile object. A winch 94 would be located at each end of the surface spreader 10 to permit uniform advancement of the surface spreader 10.

From the discussion above, the means of utilization of the surface spreader 10 is apparent. For spans of concrete which encounter no column, or between columns, the surface spreader is used in the normal manner, with the hardener being dispensed from the hopper 16 as the hopper traverses the ribbon of concrete 14. When a column 24 is encountered, however, the column assembly 26 is attached to the column 24 as described above. The surface spreader 10 is then advanced toward the column until the ski 64 is situated as far as possible upon the horizontal shelf 28. The leading leg assembly 72 adjacent the column 24 is then removed by removal of the locking bolts 90. At this point, the surface spreader is supported partially by the column assembly 26 and partially by the trailing leg assembly 72. The surface spreader 10 is then advanced with the ski 64 riding on the shelf 28 until the trailing leg assembly encounters the horizontal shelf 28. Then the trailing leg assembly is also removed.

To remove the surface spreader 10 from the column assembly 26, the reverse of the above sequence is performed. The surface spreader 10 is moved forward along the horizontal shelf 28 until the leading leg assembly 72 can be replaced. Then, the surface spreader is moved forward again just to the point that the trailing leg assembly 22 can be replaced while the rear of the ski 64 remains upon the horizontal shelf 28. After the trailing leg assembly 72 is replaced, the surface spreader 10 is then advanced in the normal fashion until the next column 24 is encountered and the above steps are repeated.

Achievements

The invention provides a simple and effective means of bypassing a column which, in the past, would have required lateral displacement of the surface spreader 10, possible marring of the freshly-poured concrete, and uneven spreading of the hardener by hand-casting to cover any gaps occurring. By utilization of the column assembly 26 in combination with the supporting ski 64 and removable leg assembly 72, the surface spreader may be advanced in the normal manner and continual widths of hardener may be applied to the concrete without fear of skipping any portion or causing gaps or damage to the concrete because of the intervening column.

Because the height of the column assembly 26 and the height of the removable end supports 70 is adjustable, the horizontal shelf 28 and ski 64 can be oriented at a proper and desired vertical elevation in alignment with one another. Thus, no matter what the desired height of the hopper 16 above the concrete 14, the adjustability of the shelf 28 and the ski 64 assure that they can be oriented properly to affect transfer of the weight of the end of the surface spreader 10 from the end supports to the column 26.

Various changes can be made to the invention without departing from the spirit thereof or scope of the following claims.

What is claimed is:

1. In a surface spreader for applying particulate material in strip fashion to the surface of freshly-poured concrete, the spreader having an elongated framework structure spanning the concrete, a hopper suspended on the framework structure and adapted to traverse the framework structure from one end to the other to spread material in a strip over the surface of the spanned concrete, and end supports at either end of the framework structure to support the framework structure above the concrete, the improvement comprising:

an apparatus for accommodating and avoiding the interference of a column in line with an end support of the surface spreader, the apparatus including a. an assembly for attachment to the column for supporting an end of the surface spreader, said assembly including a horizontal shelf and means to affix said shelf to the column at a predetermined elevation in registration with the end of the surface spreader, and b. ski means mounted at the end of the surface spreader, said ski means being shaped to engage said shelf and support the end of the surface spreader on said shelf and being mounted at approximately the same elevation as said shelf.

2. The surface spreader according to claim 1 in which said assembly includes a pair of elongated horizontal braces mounting said shelf, said braces being spaced to accept a column therebetween.

3. The surface spreader according to claim 2 including a vertical leg for each said horizontal brace, said leg being attached to said brace such that when said assembly is secured to the column, said leg is on the opposite side of said column from said shelf.

4. The surface spreader according to claim 3 in which said legs are adjustable to alter the elevation of said shelf.

5. The surface spreader according to claim 3 in which said means to affix comprises a horizontal bar extending between said horizontal braces on the opposite side of the column from said shelf and a tether means extending from one said leg to the other leg, said tether means being formed to pass about the column on the opposite side from said horizontal bar.

6. The surface spreader according to claim 5 in which said tether means comprises an adjustable, flexible chain.

7. The surface spreader according to claim 5 in which one end of said horizontal bar is pivotally attached to one of said horizontal braces, and including means to removably attach the other end of said horizontal bar to the other of said horizontal braces.

8. The surface spreader according to claim 1 in which said ski means comprises an elongated plate having upturned ends, said plate being attached to an end of the framework structure.

9. The surface spreader according to claim 1 including means removably attaching said end supports to said framework structure.

10. The surface spreader according to claim 9 in which each said end support includes a leg assembly having a vertical bearing member, and said removable attachment means comprises a vertical brace having a channel shaped to accommodate said vertical bearing member, and means to fasten said vertical bearing member to said brace.

11. The surface spreader according to claim 10 in which said fasten means comprises a series of apertures in said brace in alignment with a series of apertures in said vertical bearing member, and at least one locking bolt passing through one of said series of aligned apertures.

12. An assembly for attachment to a column for supporting an end of a surface spreader which applies particulate material to the surface of concrete, the assembly comprising a. a horizontal shelf for supporting the spreader end, b. a pair of elongated horizontal braces extending from said shelf, said braces being spaced to accept a column therebetween, c. a vertical leg for each said brace, said leg being attached to said brace on the opposite side of said column said shelf, and d. means to affix said shelf to said column.

13. The assembly according to claim 12 in which said legs are adjustable to alter the elevation of said shelf.

14. The assembly according to claim 12 in which said means to affix comprises a horizontal bar extending between said horizontal braces on the opposite side of the column from said shelf and a tether means extending from one said leg to the other leg, said tether means being formed to pass about the column on the opposite side from said horizontal bar.

15. The assembly according to claim 12 in which one end of said horizontal bar is pivotally attached to one of said horizontal braces, and including means to removably attach the other end of said horizontal bar to the other of said horizontal braces.

* * * * *